US012359533B1

(12) United States Patent
AlMatrodi et al.

(10) Patent No.: US 12,359,533 B1
(45) Date of Patent: Jul. 15, 2025

(54) RETRIEVABLE ELECTRIC SUBSURFACE SAFETY VALVE AND NIPPLE ASSEMBLY

(71) Applicant: Saudi Arabian Oil Company, Dhahran (SA)

(72) Inventors: Abdulmalek Sulaiman AlMatrodi, Dammam (SA); Ahmed Showqi Al Alshaikh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/412,091

(22) Filed: Jan. 12, 2024

(51) Int. Cl.
*E21B 34/06* (2006.01)
*E21B 34/10* (2006.01)
*E21B 47/12* (2012.01)

(52) U.S. Cl.
CPC ..... *E21B 34/066* (2013.01); *E21B 34/105* (2013.01); *E21B 47/12* (2013.01)

(58) Field of Classification Search
CPC ..... E21B 34/066; E21B 34/105; E21B 47/12; E21B 2200/05; E21B 2200/04
See application file for complete search history.

(56) References Cited

U.S. PATENT DOCUMENTS 4,066,128 A * 1/1978 Davis ..... E21B 34/14 166/373
4,667,736 A * 5/1987 Rumbaugh ..... E21B 23/03 251/30.01
4,798,247 A 1/1989 Deaton et al.
5,070,944 A * 12/1991 Hopper ..... E21B 34/066 251/129.21
6,102,828 A 8/2000 MacKenzie
6,619,388 B2 9/2003 Dietz et al.
6,719,057 B2 4/2004 Johansen
7,640,989 B2 * 1/2010 Williamson, Jr. .... E21B 34/066 166/66.5
7,967,074 B2 6/2011 Lake et al.
8,464,799 B2 * 6/2013 Scott ..... E21B 34/16 166/373
8,511,374 B2 8/2013 Scott et al.
9,291,033 B2 3/2016 Scott et al.
9,909,387 B2 3/2018 Scott et al.
10,920,529 B2 * 2/2021 Mailand ..... E21B 41/0021
(Continued)

FOREIGN PATENT DOCUMENTS

AU 2009276908 5/2015
AU 2016398435 4/2021
(Continued)

*Primary Examiner* — Yong-Suk (Philip) Ro
(74) *Attorney, Agent, or Firm* — Fish & Richardson P.C.

(57) ABSTRACT

A well system includes an electrically operated wireline-retrievable subsurface safety valve (WLSSSV) disposed in a landing nipple assembly attached to a production tubing string. The WLSSSV includes an electrical actuator and a first electrical connector. The nipple assembly includes a second electrical connector on a first end of a lever that pivots on a fulcrum as a second end of the lever engages against an external surface of the WLSSSV as the WLSSSV is inserted into the main bore of the nipple assembly, thereby rotating the second connector towards the first connector to at least partially align the second connector with the first connector for electrical engagement of the first connector with the second connector.

20 Claims, 6 Drawing Sheets

(56) References Cited

U.S. PATENT DOCUMENTS

| | | | | |
|---|---|---|---|---|
| 11,851,985 | B1 | 12/2023 | AlMatrodi | |
| 2002/0108747 | A1* | 8/2002 | Dietz | E21B 34/066 166/66.4 |
| 2010/0025045 | A1* | 2/2010 | Lake | E21B 34/066 166/373 |

FOREIGN PATENT DOCUMENTS

| | | |
|---|---|---|
| CA | 2244942 | 2/2005 |
| EP | 2861818 | 11/2018 |

* cited by examiner

RETRIEVABLE ELECTRIC SUBSURFACE SAFETY VALVE AND NIPPLE ASSEMBLY

TECHNICAL FIELD

This disclosure relates generally to fluid flow control within a subterranean well and in particular, to subsurface safety valves located downhole within the subterranean well.

BACKGROUND

In hydrocarbon production, a wellbore is drilled into a hydrocarbon-rich geological formation. After the wellbore is partially or completely drilled, a completion system is installed to secure the wellbore in preparation for production or injection. The completion system can include casing cemented in the wellbore to help control the well and maintain well integrity, and a production tubing positioned within the casing through which oil, gas, or other produced fluids can flow from the producing formation to the surface.

A wireline-retrievable subsurface safety valve can be installed within a nipple assembly installed on the production tubing, some distance below the surface. The subsurface safety valve can be configured to close in the event of an emergency or other condition, thereby preventing flow of fluid through the production tubing.

SUMMARY

Certain aspects of the subject matter herein can be implemented as a well system. The system includes a production tubing string disposed within a wellbore, a landing nipple assembly attached to the production tubing string, and an electrically operated wireline-retrievable subsurface safety valve (WLSSSV). The WLSSV includes a main WLSSSV body with a central flow bore extending there-through, a closure member, a first connector of a pair of electrical connectors, and an electrical actuator. The electric actuator is configured to, in response to an electrical signal received via the first connector, switch the closure member between a closed state in which the closure member blocks fluid flow through the central flow bore and an open state in which the closure member does not block fluid flow through central flow bore. The nipple assembly includes a main nipple assembly body with a central bore configured to receive the WLSSSV therein and a lever assembly disposed within the main nipple assembly body. The lever assembly includes a fulcrum, a lever pivotably attached to the fulcrum, and a second connector of the pair of electrical connectors, the second connector attached to a first end of the lever. The nipple assembly and the WLSSSV are configured such that, when the WLSSSV is received within the main nipple body, the lever pivots at the fulcrum as a second end of the lever engages against an external surface of the WLSSSV, thereby rotating the second connector towards the first connector to at least partially align the second connector with the first connector for electrical engagement of the first connector with the second connector.

Certain aspects of the subject matter herein can be implemented as a nipple assembly. The nipple assembly includes a main nipple assembly body with a central bore configured to receive a WLSSSV therein. The WLSSSV includes a main WLSSSV body with a central flow bore extending there-through, a closure member, and an electrical actuator. The electric actuator is configured to, in response to an electrical signal received via the first connector, switch the closure member between a closed state in which the closure member blocks fluid flow through the central flow bore and an open state in which the closure member does not block fluid flow through central flow bore. The nipple assembly also includes a lever assembly disposed within the main nipple assembly body. The lever assembly includes a fulcrum, a lever pivotably attached to the fulcrum, and a second connector of the pair of electrical connectors. The second connector is attached to a first end of the lever. The nipple assembly and the WLSSSV are configured such that, when the WLSSSV is received within the main nipple assembly body, the lever pivots at the fulcrum as a second end of the lever engages against an external surface of the WLSSSV, thereby rotating the second connector towards the first connector to at least partially align the second connector with the first connector for electrical engagement of the first connector with the second connector.

Certain aspects of the subject matter herein can be implemented as a method. The method includes attaching a nipple assembly to a production tubing string. The nipple assembly includes a main nipple assembly body with a central bore configured to receive a WLSSSV therein. The WLSSSV includes a main WLSSSV body with a central flow bore extending there-through, a closure member, a first connector of a pair of electrical connectors, and an electrical actuator. The electric actuator configured to, in response to an electrical signal received via the first connector, switch the closure member between a closed state and an open state. The nipple assembly also includes a lever assembly disposed within the main nipple assembly body that includes a fulcrum, a lever pivotably attached to the fulcrum, and a second connector of the pair of electrical connectors, the second connector attached to a first end of the lever. The method further includes disposing the production tubing string with the nipple assembly attached into a wellbore and lowering the WLSSSV into the production string and into the central bore of the main nipple assembly body, such that the lever pivots at the fulcrum as a second end of the lever engages against an external surface of the WLSSSV, thereby rotating the second connector towards the first connector to at least partially align the second connector with the first connector. With the first connector and the second connector aligned, the method further includes stabbing the first connector and the second connector into electrical engagement and, with the pair of electrical connectors engaged, transmitting the electrical signal to the actuator via pair of electrical connectors.

Certain aspects of the subject matter herein can be implemented as a WLSSSV configured to be received within a central bore of a nipple assembly attached to a production tubing string. The WLSSV includes a main WLSSSV body with a central flow bore extending there-through, a closure member, and a first connector of a pair of electrical connectors. The first connector is disposed within a recess in an external surface of the main WLSSV body. The recess and the connector are configured to receive within the recess a second connector of the pair of electrical connectors that rotates into the recess on a first end of a lever of a lever assembly of the nipple assembly that pivots on a fulcrum within the nipple assembly as a second end of the lever engages against an external surface of the WLSSSV as the WLSSSV is received within the main nipple assembly body, thereby at least partially aligning the second connector with the first connector for electrical engagement of the first connector with the second connector. The WLSSSV also includes an electrical actuator configured to, in response to an electrical signal received via the first connector, switch the closure member between a closed state in which the closure member blocks fluid flow through the central flow bore and an open state in which the closure member does not block fluid flow through central flow bore.

DETAILED DESCRIPTION

Wireline-retrievable subsurface safety valves (WLSSSVs) installed within nipple assemblies on production tubing can provide a fail-safe mechanism for preventing fluid flow through the production tubing in the event of an emergency or other condition. The opening and closing of the valves can be controlled by, for example, the application and removal of hydraulic pressure carried from a surface facility through a hydraulic control line. However, such hydraulic control lines can be fragile and prone to corrosion or leakage. If electrical actuators are used in lieu of hydraulic actuation, difficulty can be encountered in forming the requisite electrical connection with a retrievable valve actuator such that electrical signals can be reliably conveyed to and from the surface. These shortcomings can result in premature valve closure or other potentially hazardous or undesirable conditions, decreasing operational efficiency, and increasing well cost.

In accordance with an embodiment of the present disclosure, an improved system and method for deploying and operating a WLSSSV is disclosed. In some embodiments, the system can include a nipple assembly connected to a production tubing string. The nipple assembly can include an electrical connector connected to a lever assembly, such that the insertion of the WLSSSV into the nipple assembly pivots the lever to position the connector of the nipple assembly for connection with the connector of the WLSSSV. The method and system of the present disclosure can provide a simple and more efficient system than prior designs, thus reducing costs, reducing environmental and safety risks, and increasing production. Because no hydraulic connectivity is required, the assemblies can require fewer seals. Furthermore, proper downhole operation of the SSSV can be monitored and problems more easily and efficiently identified using embedded pressure sensors within the actuator assembly.

Figure 1:
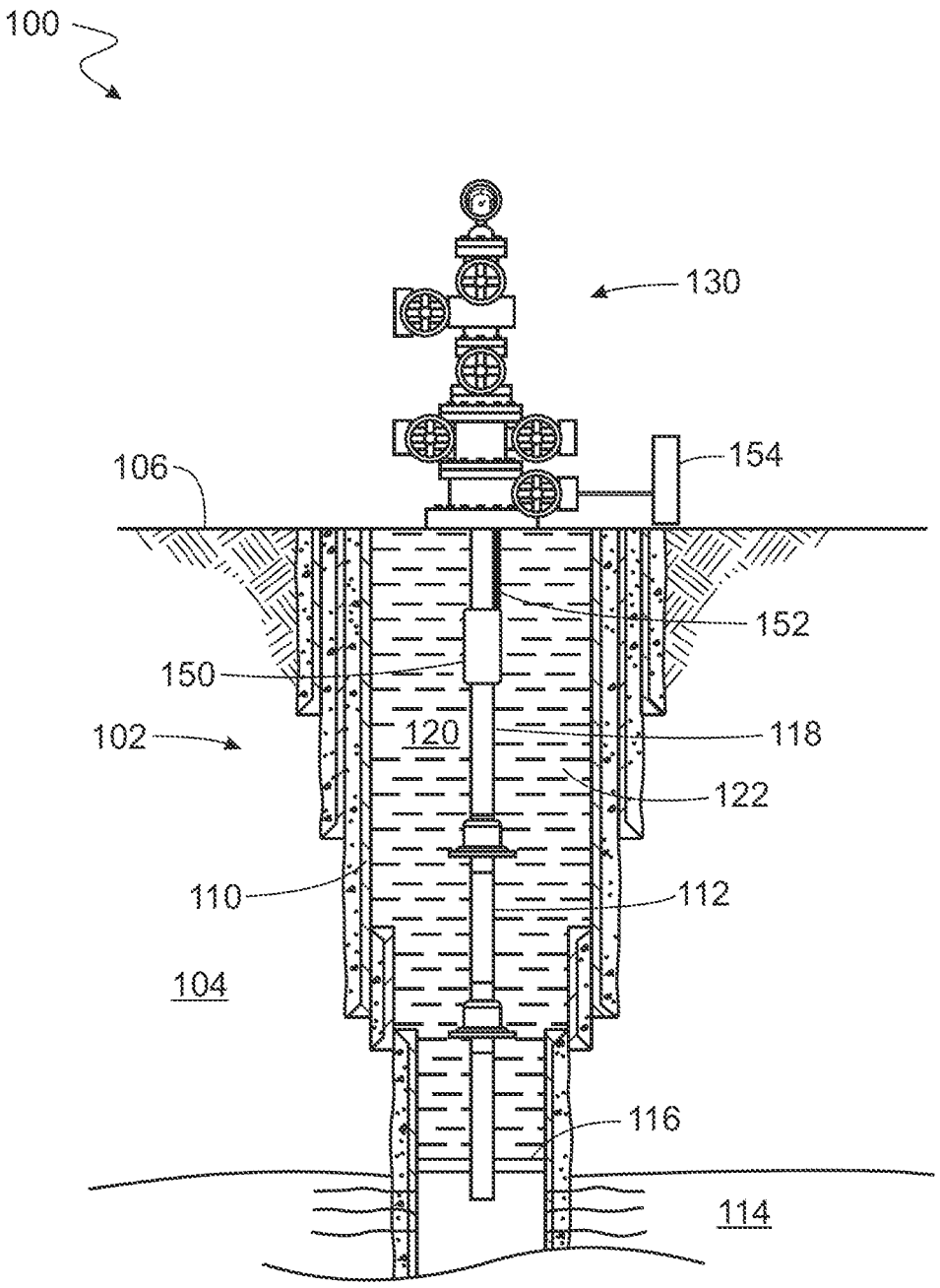
FIG. 1 is a schematic illustration of a well system in accordance with an embodiment of the present disclosure.

FIG. 1 is a schematic illustration of a well system in accordance with an embodiment of the present disclosure. Referring to FIG. 1, well system 100 includes a wellbore 102 drilled into a subterranean zone 104 from the Earth's surface 106. Casing string 110 is disposed within wellbore 102 and can include multiple nested casings of different diameters, and can be perforated (for example, proximate to its downhole end) so as to allow produced fluids to flow into the cased wellbore.

Production tubing string 112 is positioned within casing string 110 and provides a passageway through which produced fluid 108 from production zone 114 of subterranean zone 104 can reach the surface 106. A production packer 116 anchors and isolates the bottom of the production tubing string. When disposed in wellbore 102, production tubing string 112 can be partially or completely filled with wellbore fluid.

The inner surface of casing string 110 and the outer surface 118 of production tubing 112 define (or partially define) the tubing-casing annulus (TCA) 120. TCA fluid 122 fills or substantially fills TCA 120 uphole of packer 116 and can include or can be a mixture of diesel, brine, or other suitable fluid. Well system 100 further includes a wellhead assembly 130 which can include hangers for casing string 110 and production tubing string 112 and can include various valves, spools, pressure gauges and chokes to regulate and control production of produced fluids 108 from wellbore 102. Produced fluids 108 can be flowed from wellhead assembly 130 via a production line (not shown) or other conveyance towards pipelines or other surface treatment, gathering, or conveyance facilities.

Well system 100 also includes a landing nipple assembly 150 connected to production tubing string 112, configured to receive and hold a WLSSSV. As described in greater detail in FIGS. 2A and 2B, the WLSSSV can include a closure member (such as a flapper or ball valve) that permits fluid flow through the central bore when in an open position (thus permitting fluid to flow in an uphole or downhole direction through production tubing 112) and that prevents fluid flow through the central bore when in a closed state (thus preventing fluid flow in an uphole or downhole direction through production tubing 112). Landing nipple assembly 150 is described in greater detail in reference to FIGS. 3A and 3B.

Well system 100 can further include an electric cable 152 which can be configured to supply an electric signal to and from nipple assembly 150 (and WLSSSV disposed therein) to or from control module 154. In some embodiments the electric signal can include an electric current (or a termination (or other cessation) of an electric current), a control signal, a data signal, or another suitable electric signal. Control module 154 can in some embodiments include a surface panel or other output device for displaying pressure measurements and other information, and for sending electric signals to the sensor and actuators in the WLSSSV disposed in nipple actuator assembly 150.

In some embodiments, control module 154 is on a surface location at the wellsite proximate to wellhead assembly 130 and other wellsite equipment. In other embodiments, control module 154 can be remote from the wellsite and/or positioned at a subsurface or downhole location. In some embodiments, control module 154 can be part of and/or in communication with and/or controlled by another remote or wellsite monitoring and control system such as a supervisory control and data acquisition (SCADA) system. In some embodiments, control module 154 is a portable system.

In some embodiments, control module 154 can be (or can include) a computer system that comprises one or more processors, and a computer-readable medium (for example, a non-transitory computer-readable medium) storing computer instructions executable by the one or more processors to perform operations that can include, for example, controlling an actuator within the WLSSSV disposed within nipple assembly 150, and others.

Figure 2A:
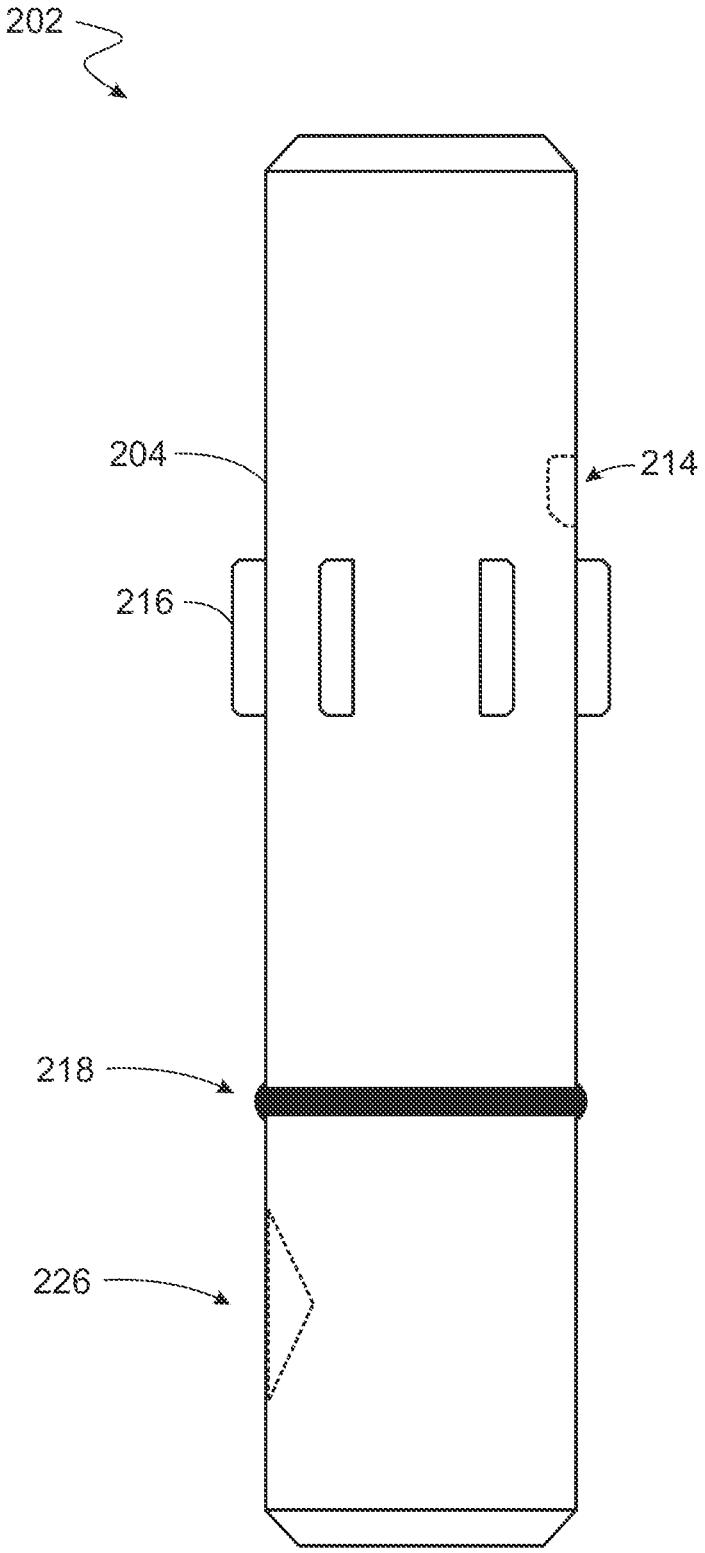
FIGS. 2A and 2B are schematic illustration of a wireline-retrievable subsurface safety valve in accordance with an embodiment of the present disclosure.
Figure 2B:
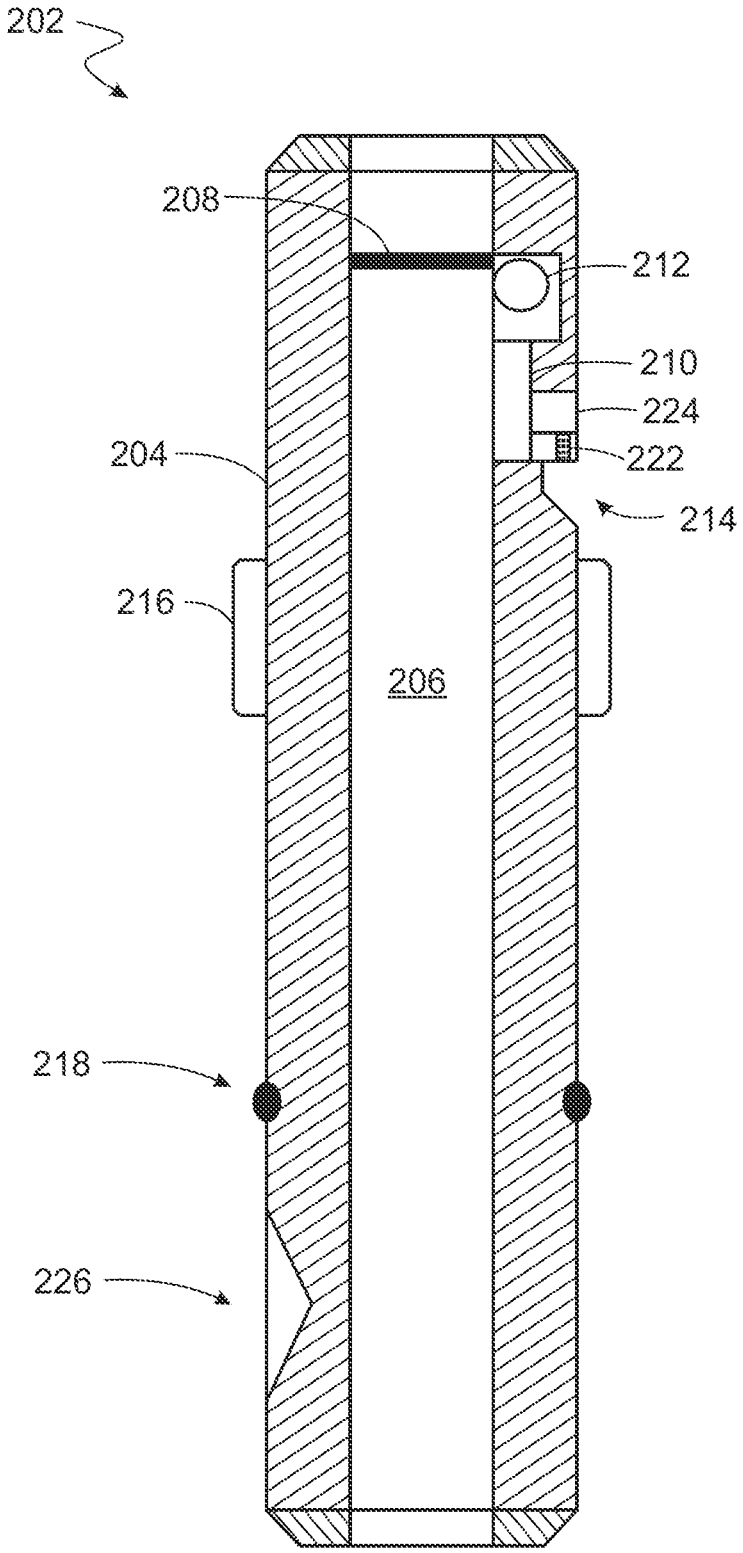

A WLSSSV in accordance with embodiments of the present disclosure is shown in FIGS. 2A and 2B, with FIG.

2B being a cross-sectional view. WLSSSV 202 comprises a main WLSSV body 204 with a central flow bore 206 extending longitudinally therethrough, and closure member 208, which in some embodiments can be a flapper or another suitable closure member (such as a ball valve), biased to a closed state by a biasing mechanism 212 (which can be, for example, a coil spring). In the closed state, closure member 208 blocks fluid flow through central flow bore 206.

Electric actuator 210 is configured to, in response to a first electrical signal, switch from the closed state to an open state in which the closure member 208 (by, for example, being rotated by the actuator against the biasing force of the biasing mechanism 212) does not block fluid flow through central flow bore 206. The first electric signal can be, for example, a transmission of electrical current to actuator 210. In response to a second electrical signal (which can be, for example, a cessation of electrical current to actuator 210), closure member can switch from the open state to the closed state (driven by, for example, the biasing force of biasing mechanism 212 upon release of force from the actuator). In some embodiments, the electric signal change can be caused by (for example) a well control event or other trigger acting on (or damaging or destroying) the surface control module, such that the nipple assembly and WLSSSV are part of a "fail-safe" system, closing the production tubing string against fluid flow in the event of a catastrophic event or other circumstance in which well closure is desirable.

In the illustrated embodiment, the electrical signals to actuator 210 can be received via a connection to an electrical connector 222. As described in greater detail below, connector 222 can be one of a pair of connectors (for example, a female connector from a pair of wet-mate connectors), with the other connector of the pair of connectors (for example, the male connector from the pair of wet-mate connectors) as part of nipple assembly 150 (FIG. 1) and engaged with connector 222 upon insertion of WLSSSV 202 within the nipple assembly 150. Suitable connectors can include, for example, wet-mate connectors available from iConn Systems, LLC. In the illustrated embodiment, connector 222 is positioned within a recess 214 so that the connector is shielded from impact from debris or components of the well system as it is disposed downhole.

Connector 222 can also convey an electrical signal to or from sensors 224. Sensors 224 can include, for example, one or more pressure sensors configured to measure fluid pressure within bore 206. Such pressure data can be used to by the operator to confirm a valve state (open or closed) and may indicate leakage or other valve failure. Sensors 224 can also include one or more position sensors to provide an indication to the operator of the position of closure member 208. Sensors 224 can also include temperature, ultrasonic, or other suitable sensors. Sensor data and control signals can be managed by the operator using a surface SCADA control panel or other suitable system.

Figure 3A:
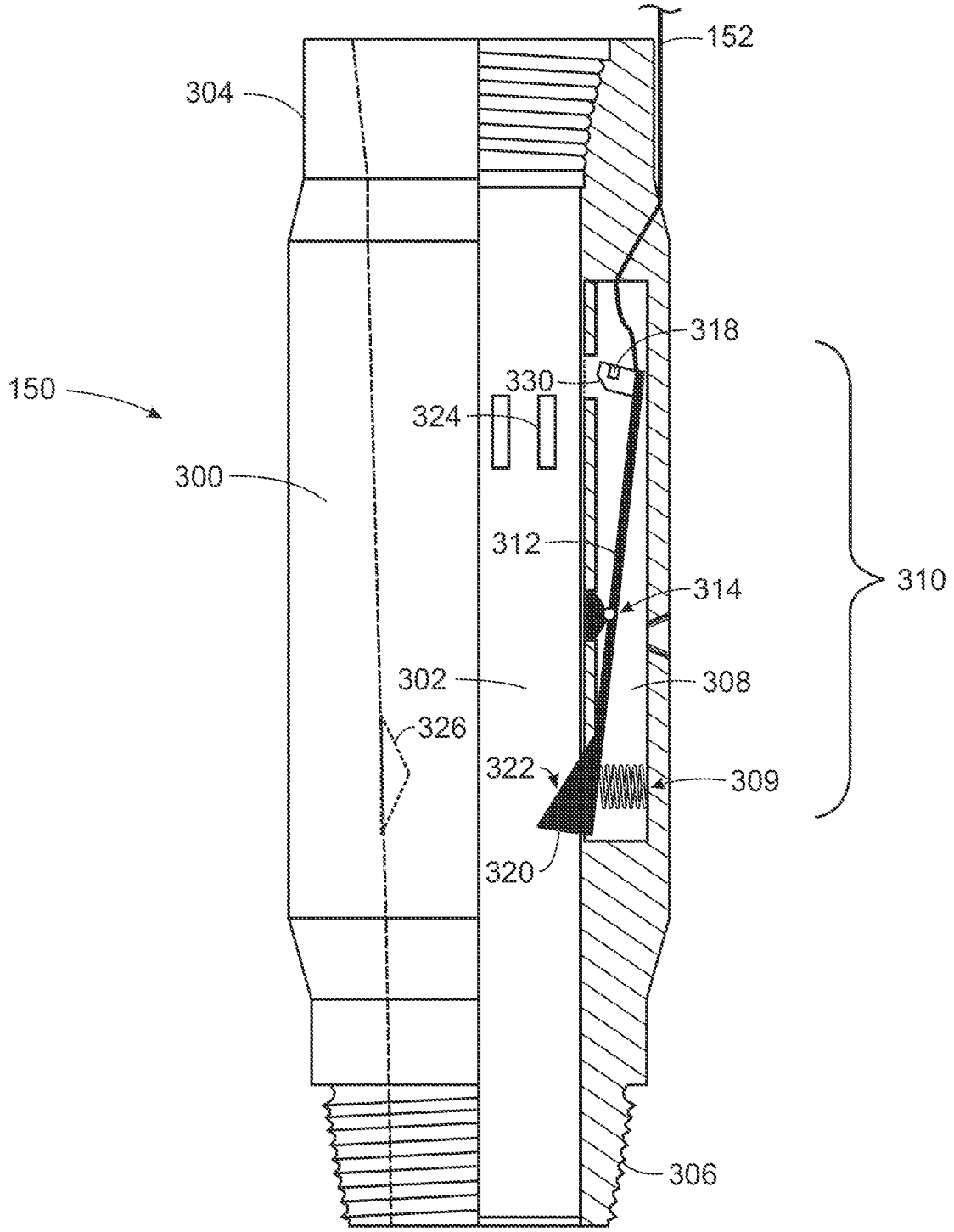
FIGS. 3A and 3B are schematic illustrations of a landing nipple assembly for a wireline-retrievable subsurface safety valve in accordance with an embodiment of the present disclosure.
Figure 3B:
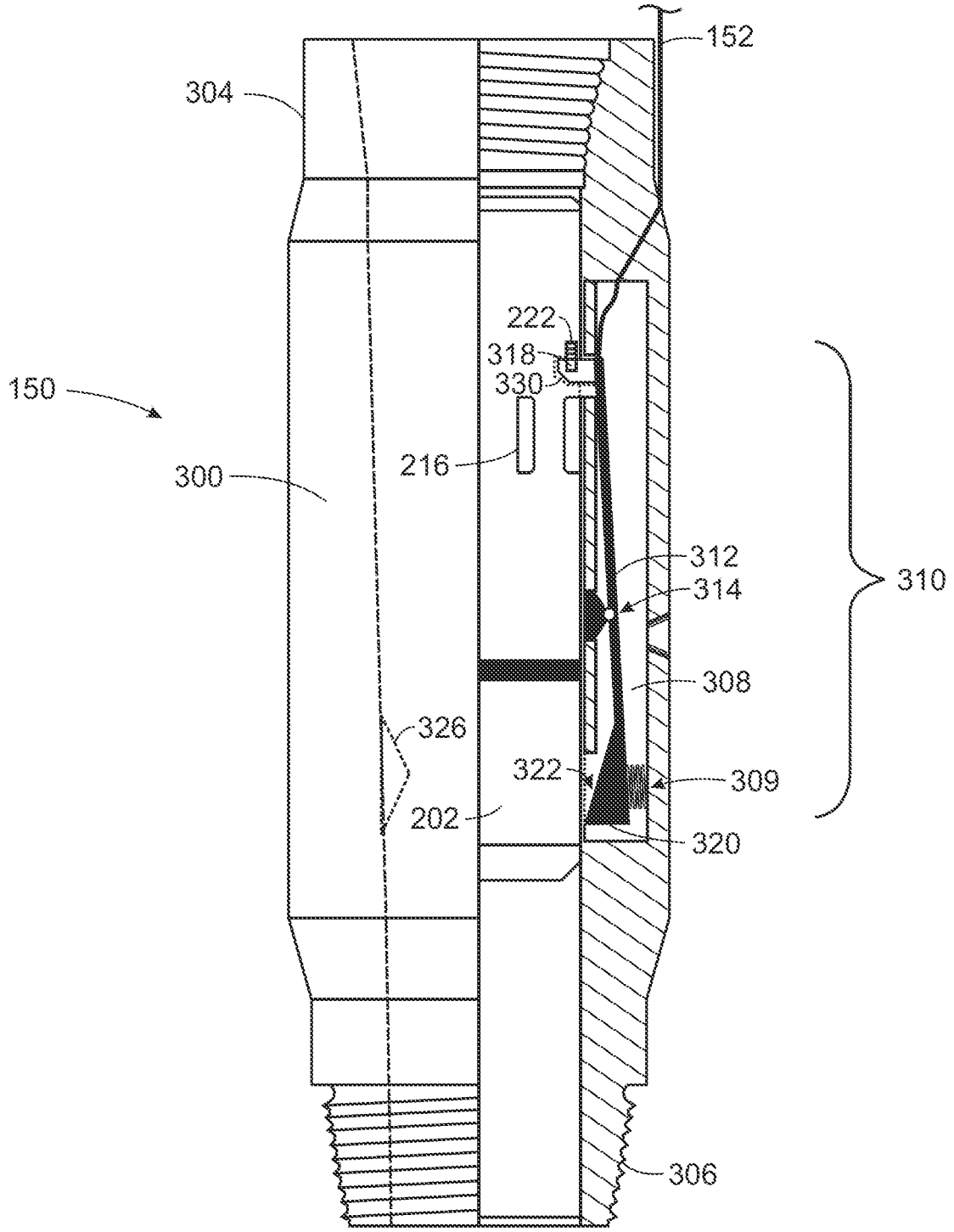

WLSSSV 202 further comprises a guide slot 226 configured to interface with a guide profile on the nipple profile so as to orient WLSSSV 202 correctly within nipple assembly 150 such that connector 222 aligns vertically and horizontally with the corresponding connector of nipple assembly 150 (see FIG. 3B). Guide slot 226 can be or can include a spiral groove or other suitable mechanism to rotate WLSSSV to the desired horizontal (rotational) position as it is lowered into the nipple assembly. When correctly inserted and oriented within the nipple assembly, key profiles 216 lock into corresponding nipple profiles of the nipple assembly, as described below. In some embodiments, key profiles 216 can include springs or other biasing mechanisms to enable WLSSSV 202 to be unlocked from the nipple assembly by the application of sufficient upward force (by, for example, a wireline retrieval tool) and removed from the nipple assembly and pulled from the wellbore. In the illustrated embodiment, WLSSSV 202 further includes one or more seals 218 to prevent leakage of fluids uphole around WLSSSV when it is disposed in the nipple assembly. Seals 218 can comprise elastomer seals or other suitable seals.

FIGS. 3A and 3B are schematic illustrations of nipple assembly 150 of FIG. 1 in accordance with some embodiments of the present disclosure. Referring to FIG. 3A, nipple assembly 150 includes a main nipple assembly body 300 with a central receptacle bore 302 in-line with the bore of the production tubing string. Upper threaded portion 304 provides a connection to the production tubing uphole of the nipple assembly, and lower threaded portion 306 provides a connection to the production tubing downhole of the nipple assembly. Central receptacle bore 302 is sized and configured to receive WLSSSV 202, as described in greater detail below.

A lever assembly 310 is disposed within a sidewall cavity 308 defined in part by main nipple assembly body 300. Lever assembly 310 includes a lever 312 pivotably attached to a fulcrum 314. At a first (uphole) end of the lever is a connector 318, which can be the other of the pair of connectors that includes connector 222 of WLSSSV 202 (for example, a male wet-mate connector corresponding to connector 222 which can be a female wet-mate connector). Spring 309 biases lever 312 in the position in which connector 318 is entirely within sidewall cavity 308. Upon insertion, as WLSSSV 202 slides into central bore 302, guide profile 326 engages with guide slot 226 to orient connector 318 with connector 222 and, as the biasing force of spring 309 is overcome, lever 312 pivots at fulcrum 314 at the bottom end 320 of lever 312, thereby rotating connector 318 towards WLSSSV 202. The rotation of connector 318 together with the rotational alignment from guide slot 226 vertically and horizontally align connector 222 with connector 318 for electrical engagement. With the connectors so aligned, the weight of the WLSSV or the setting action can vertically stab the connectors 222 and 318 into electrical engagement. "Vertically stab" as used herein means stab in a direction substantially parallel with the main axis of the production tubing. WLSSSV 202 is releasably locked into place by mechanical engagement of nipple profiles 324 with corresponding key profiles 216. So positioned as shown in FIG. 3B with connectors 222 and 318 engaged, electrical signals can be conveyed between surface control module 154 and the actuator, sensor, and other electrical components WLSSSV 202.

In the event retrieval of WLSSSV 202 from nipple assembly 150 is desired, the WLSSSV can be unlocked from nipple assembly 150 by pulling the WLSSSV with a wireline retrieval tool with sufficient force to overcome the biasing mechanisms in the key profiles 216. In the illustrated embodiment, as WLSSSV 202 is pulled from the nipple assembly, the biasing force of spring 309 rotates connector 318 away from the WLSSSV and back into the sidewall cavity 308. The sloped surface 330 of connector 318 further aids in this rotation of connector 318 into cavity 308. WLSSSV 202 can then be pulled out of nipple assembly 150 and brought to the surface. In this way, actuator 210, sensor 224, and the other components can be easily inspected or replaced as necessary.

Figure 4:
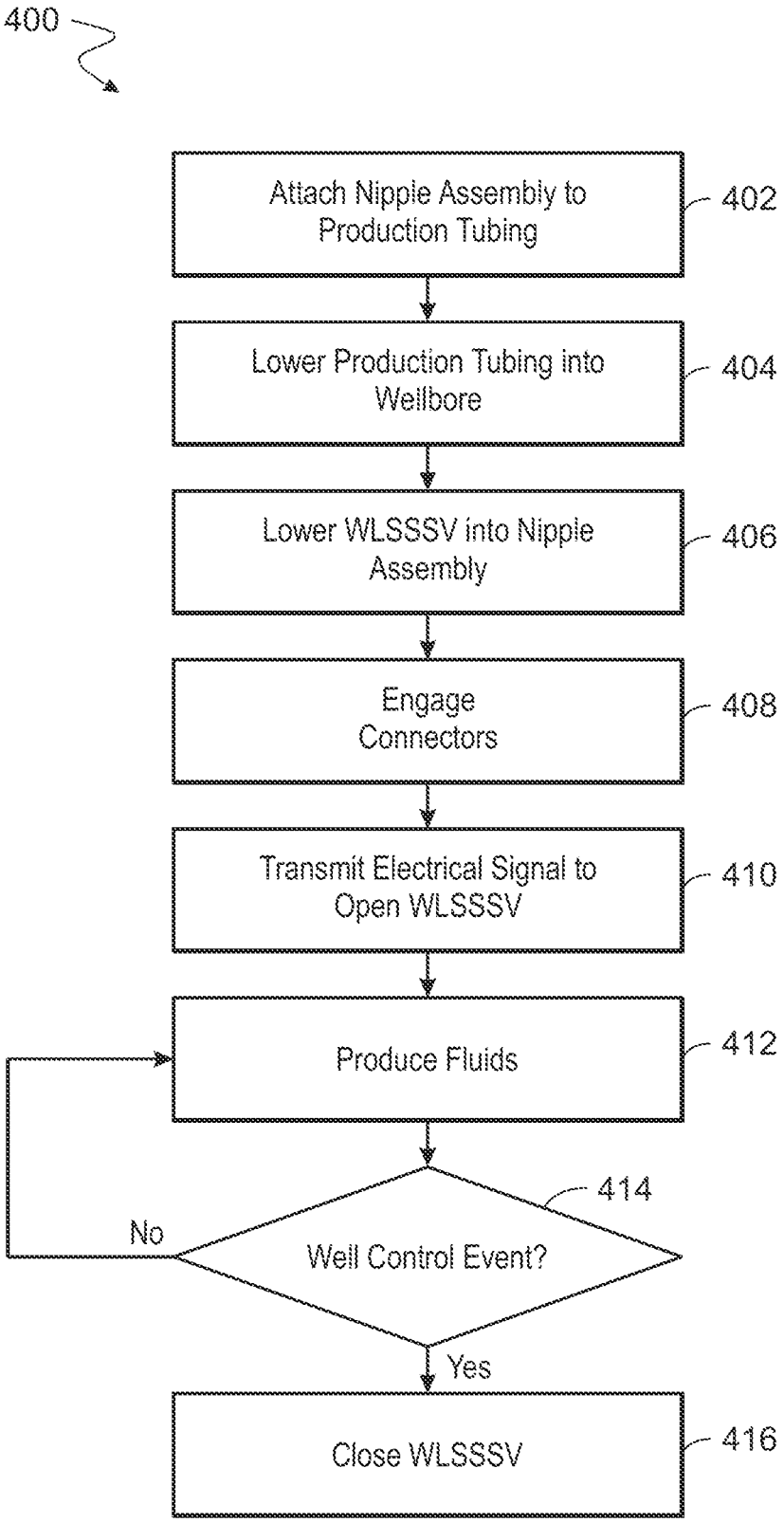
FIG. 4 is a process flow diagram of operating a well system with a wireline-retrievable subsurface safety valve in accordance with an embodiment of the present disclosure.

FIG. 4 is a process flow diagram of a method 400 of installing and operating a WLSSSV in accordance with embodiments of the present disclosure. Method 400 will be described in reference to system 100 described in reference to the above figures. The method begins at step 402 in which nipple assembly 150 is attached to production tubing 112 at a surface location. The method then proceeds to step 404 in which production tubing 112, with nipple assembly 150 attached, is lowered into the wellbore. As step 406, after the production string and nipple assembly are disposed in the wellbore, a WLSSSV is lowered downhole such that the WLSSSV 202 is inserted into the central bore of nipple assembly 150 with the lever assembly and guide profile aligning the electrical connectors such that, at step 408, they can be electrically engaged.

At step 410, the operator transmits an electric signal to actuator 210 within the WLSSSV 202, and the actuator overcome the biasing force from biasing mechanism 210 to thereby move closure member 208 to the open position, such that, at step 412, hydrocarbons or other fluids can be produced to the surface.

If at step 414 a well control emergency event or other event or circumstance occurs in which valve closure is necessary or desired, then the method proceeds to step 416 in which, in response to an electric signal change (such as a cessation of an electric current or a control signal), the actuator can release to permit closure of the closure member by force of the biasing mechanism, such that fluid can no longer flow through the production tubing.

The term "uphole" as used herein means in the direction along the production tubing or the wellbore from its distal end towards the surface, and "downhole" as used herein means the direction along a tubing string or the wellbore from the surface towards its distal end. A downhole location means a location along the tubing string or wellbore downhole of the surface.

EXAMPLES

In a first aspect, a well system includes a production tubing string disposed within a wellbore, a landing nipple assembly attached to the production tubing string, and an electrically operated wireline-retrievable subsurface safety valve (WLSSSV). The WLSSV includes a main WLSSSV body with a central flow bore extending there-through, a closure member, a first connector of a pair of electrical connectors, and an electrical actuator. The electric actuator is configured to, in response to an electrical signal received via the first connector, switch the closure member between a closed state in which the closure member blocks fluid flow through the central flow bore and an open state in which the closure member does not block fluid flow through central flow bore. The nipple assembly includes a main nipple assembly body with a central bore configured to receive the WLSSSV therein and a lever assembly disposed within the main nipple assembly body. The lever assembly includes a fulcrum, a lever pivotably attached to the fulcrum, and a second connector of the pair of electrical connectors, the second connector attached to a first end of the lever. The nipple assembly and the WLSSSV are configured such that, when the WLSSSV is received within the main nipple body, the lever pivots at the fulcrum as a second end of the lever engages against an external surface of the WLSSSV, thereby rotating the second connector towards the first connector to at least partially align the second connector with the first connector for electrical engagement of the first connector with the second connector.

In a second aspect in accordance with the first aspect, the lever assembly further includes a spring which biases the lever such that the second connector rotates away from the first connector as the WLSSSV is removed from the main nipple assembly body.

In a third aspect in accordance with the first or the second aspect, the main nipple assembly body at least partially defines a sidewall cavity within which the second connector is disposed while in a retracted position and out from which the second connector at least partially exits as it rotates from the retracted position towards the first connector.

In a fourth aspect in accordance with any of the first to third aspects, the electrical signal is an electrical current conveyed from the surface via an electrical line to the nipple assembly and through the pair of electrical connectors when the pair of electrical connectors are electrically engaged.

In a fifth aspect in accordance with any of the first to fourth aspects, the WLSSSV further includes a pressure sensor and wherein data from the pressure sensor is conveyed through the pair of electrical connectors when the pair of electrical connectors are electrically engaged.

In a sixth aspect, a nipple assembly includes a main nipple assembly body with a central bore configured to receive a WLSSSV therein. The WLSSSV includes a main WLSSSV body with a central flow bore extending there-through, a closure member, and an electrical actuator. The electric actuator is configured to, in response to an electrical signal received via the first connector, switch the closure member between a closed state in which the closure member blocks fluid flow through the central flow bore and an open state in which the closure member does not block fluid flow through central flow bore. The nipple assembly also includes a lever assembly disposed within the main nipple assembly body. The lever assembly includes a fulcrum, a lever pivotably attached to the fulcrum, and a second connector of the pair of electrical connectors. The second connector is attached to a first end of the lever. The nipple assembly and the WLSSSV are configured such that, when the WLSSSV is received within the main nipple assembly body, the lever pivots at the fulcrum as a second end of the lever engages against an external surface of the WLSSSV, thereby rotating the second connector towards the first connector to at least partially align the second connector with the first connector for electrical engagement of the first connector with the second connector.

In a seventh aspect in accordance with the sixth aspect, the lever assembly further includes a spring which biases the lever such that the second connector rotates away from the first connector as the WLSSSV is removed from the main nipple assembly body.

In an eighth aspect in accordance with the sixth or the seventh aspect, the main nipple assembly body at least partially defines a sidewall cavity within which the second connector is disposed while in a retracted position and out from which the second connector at least partially exits as it rotates from the retracted position towards the first connector.

In a ninth aspect in accordance with any of the sixth to eighth aspects, the electrical signal is an electrical current conveyed from the surface via an electrical line to the nipple assembly and through the pair of electrical connectors when the pair of electrical connectors are electrically engaged.

In a tenth aspect in accordance with any of the sixth to ninth aspects, the WLSSSV further includes a pressure sensor and wherein data from the pressure sensor is conveyed through the pair of electrical connectors when the pair of electrical connectors are electrically engaged.

In an eleventh aspect, a method includes attaching a nipple assembly to a production tubing string. The nipple assembly includes a main nipple assembly body with a central bore configured to receive a WLSSSV therein. The WLSSSV includes a main WLSSSV body with a central flow bore extending there-through, a closure member, a first connector of a pair of electrical connectors, and an electrical actuator. The electric actuator configured to, in response to an electrical signal received via the first connector, switch the closure member between a closed state and an open state. The nipple assembly also includes a lever assembly disposed within the main nipple assembly body that includes a fulcrum, a lever pivotably attached to the fulcrum, and a second connector of the pair of electrical connectors, the second connector attached to a first end of the lever. The method further includes disposing the production tubing string with the nipple assembly attached into a wellbore and lowering the WLSSSV into the production string and into the central bore of the main nipple assembly body, such that the lever pivots at the fulcrum as a second end of the lever engages against an external surface of the WLSSSV, thereby rotating the second connector towards the first connector to at least partially align the second connector with the first connector. With the first connector and the second connector aligned, the method further includes stabbing the first connector and the second connector into electrical engagement and, with the pair of electrical connectors engaged, transmitting the electrical signal to the actuator via pair of electrical connectors.

In a twelfth aspect in accordance with the eleventh aspect, the lever assembly further includes a biasing spring and further comprising pulling, via a wireline, the WLSSSV from the central bore of the main nipple assembly body, wherein the biasing spring biases the lever to rotate second connector rotates away from the first connector as the WLSSSV is removed from the main nipple assembly body.

In a thirteenth aspect in accordance with the eleventh or twelfth aspect, the main nipple assembly body at least partially defines a sidewall cavity within which the second connector is disposed while in a retracted position and out from which the second connector at least partially exits as it rotates from the retracted position towards the first connector.

In a fourteenth aspect in accordance with any of the eleventh to thirteenth aspects, the electrical signal is an electrical current conveyed from the surface via an electrical line to the nipple assembly and through the pair of electrical connectors when the pair of electrical connectors are electrically engaged.

In a fifteenth aspect in accordance with any of the eleventh to fourteenth aspects, the WLSSSV further includes a pressure sensor and further comprising receiving data from the pressure sensor conveyed through the pair of electrical connectors when the pair of electrical connectors are electrically engaged.

In a sixteenth aspect, a WLSSSV configured to be received within a central bore of a nipple assembly attached to a production tubing string includes a main WLSSSV body with a central flow bore extending there-through, a closure member, and a first connector of a pair of electrical connectors. The first connector is disposed within a recess in an external surface of the main WLSSV body. The recess and the connector are configured to receive within the recess a second connector of the pair of electrical connectors that rotates into the recess on a first end of a lever of a lever assembly of the nipple assembly that pivots on a fulcrum within the nipple assembly as a second end of the lever engages against an external surface of the WLSSSV as the WLSSSV is received within the main nipple assembly body, thereby at least partially aligning the second connector with the first connector for electrical engagement of the first connector with the second connector. The WLSSSV also includes an electrical actuator configured to, in response to an electrical signal received via the first connector, switch the closure member between a closed state in which the closure member blocks fluid flow through the central flow bore and an open state in which the closure member does not block fluid flow through central flow bore.

In a seventeenth aspect in accordance with the sixteenth aspect, the WLSSSV includes a pressure sensor and the WLSSSV is configured such that data from the pressure sensor can be conveyed through the pair of electrical connectors when the pair of electrical connectors are electrically engaged.

In an eighteenth aspect in accordance with the sixteenth or seventeenth aspects, the nipple assembly further includes a sidewall cavity within which the second connector is disposed while in a retracted position and out from which the second connector at least partially exits as it rotates from the retracted position towards the first connector.

In a nineteenth aspect in accordance with any of the sixteenth to eighteenth aspects, the electrical signal is an electrical current conveyed from the surface via an electrical line to the nipple assembly and through the pair of electrical connectors when the pair of electrical connectors are electrically engaged.

In a twentieth aspect in accordance with any of the sixteenth to nineteenth aspects, the WLSSSV further includes one or more key profiles configured to releasably lock the WLSSSV into the central bore of the nipple assembly.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A well system comprising:

a production tubing string disposed within a wellbore;

an electrically operated wireline-retrievable subsurface safety valve (WLSSSV) comprising a main WLSSSV body with a central flow bore extending there-through;

a closure member;

a first connector of a pair of electrical connectors; and an electrical actuator, the electric actuator configured to, in response to an electrical signal received via the first connector, switch the closure member between a closed state in which the closure member blocks fluid flow through the central flow bore and an open state in which the closure member does not block fluid flow through central flow bore; and a nipple assembly attached to the production tubing string, the nipple assembly comprising;

a main nipple assembly body with a central bore configured to receive the WLSSSV therein; and a lever assembly disposed within the main nipple assembly body and comprising:

a fulcrum;

a lever pivotably attached to the fulcrum; and a second connector of the pair of electrical connectors, the second connector attached to a first end of the lever, wherein the nipple assembly and the WLSSSV are configured such that, when the WLSSSV is received within the main nipple body, the lever pivots at the fulcrum as a second end of the lever engages against an external surface of the WLSSSV, thereby rotating the second connector towards the first connector to at least partially align the second connector with the first connector for electrical engagement of the first connector with the second connector.

2. The well system of claim 1, wherein the lever assembly further comprises a spring which biases the lever such that the second connector rotates away from the first connector as the WLSSSV is removed from the main nipple assembly body.

3. The well system of claim 1, wherein the main nipple assembly body at least partially defines a sidewall cavity within which the second connector is disposed while in a retracted position and out from which the second connector at least partially exits as it rotates from the retracted position towards the first connector.

4. The well system of claim 1, wherein the electrical signal comprises an electrical current conveyed from the surface via an electrical line to the nipple assembly and through the pair of electrical connectors when the pair of electrical connectors are electrically engaged.

5. The well system of claim 1, wherein the WLSSSV further comprises a pressure sensor and wherein data from the pressure sensor is conveyed through the pair of electrical connectors when the pair of electrical connectors are electrically engaged.

6. A nipple assembly configured to be attached to a production tubing string disposed in a wellbore, the nipple assembly comprising:

a main nipple assembly body with a central bore configured to receive a wireline-retrievable subsurface safety valve (WLSSSV) therein, wherein the WLSSSV comprises:

a main WLSSSV body with a central flow bore extending there-through;

a closure member;

an electrical actuator, the electric actuator configured to, in response to an electrical signal received via the first connector, switch the closure member between a closed state in which the closure member blocks fluid flow through the central flow bore and an open state in which the closure member does not block fluid flow through central flow bore; and a lever assembly disposed within the main nipple assembly body and comprising:

a fulcrum;

a lever pivotably attached to the fulcrum; and a second connector of the pair of electrical connectors, the second connector attached to a first end of the lever, wherein the nipple assembly and the WLSSSV are configured such that, when the WLSSSV is received within the main nipple assembly body, the lever pivots at the fulcrum as a second end of the lever engages against an external surface of the WLSSSV, thereby rotating the second connector towards the first connector to at least partially align the second connector with the first connector for electrical engagement of the first connector with the second connector.

7. The nipple assembly of claim 6, wherein the lever assembly further comprises a spring which biases the lever such that the second connector rotates away from the first connector as the WLSSSV is removed from the main nipple assembly body.

8. The nipple assembly of claim 6, wherein the main nipple assembly body at least partially defines a sidewall cavity within which the second connector is disposed while in a retracted position and out from which the second connector at least partially exits as it rotates from the retracted position towards the first connector.

9. The nipple assembly of claim 6, wherein the electrical signal comprises an electrical current conveyed from the surface via an electrical line to the nipple assembly and through the pair of electrical connectors when the pair of electrical connectors are electrically engaged.

10. The nipple assembly of claim 6, wherein the WLSSSV further comprises a pressure sensor and wherein data from the pressure sensor is conveyed through the pair of electrical connectors when the pair of electrical connectors are electrically engaged.

11. A method comprising:

attaching a nipple assembly to a production tubing string, the nipple assembly comprising:

a main nipple assembly body with a central bore configured to receive a wireline-retrievable subsurface safety valve (WLSSSV) therein, wherein the WLSSSV comprises:

a main WLSSSV body with a central flow bore extending there-through;

a closure member;

a first connector of a pair of electrical connectors; and an electrical actuator, the electric actuator configured to, in response to an electrical signal received via the first connector, switch the closure member between a closed state and an open state; and a lever assembly disposed within the main nipple assembly body and comprising:

a fulcrum;

a lever pivotably attached to the fulcrum; and a second connector of the pair of electrical connectors, the second connector attached to a first end of the lever;

disposing the production tubing string with the nipple assembly attached into a wellbore;

lowering the WLSSSV into the production string and into the central bore of the main nipple assembly body, such that the lever pivots at the fulcrum as a second end of the lever engages against an external surface of the WLSSSV, thereby rotating the second connector towards the first connector to at least partially align the second connector with the first connector;

with the first connector and the second connector aligned, stabbing the first connector and the second connector into electrical engagement; and with the pair of electrical connectors engaged, transmitting the electrical signal to the actuator via pair of electrical connectors.

12. The method of claim 11, wherein the lever assembly further comprises a biasing spring and further comprising pulling, via a wireline, the WLSSSV from the central bore of the main nipple assembly body, wherein the biasing spring biases the lever to rotate second connector rotates away from the first connector as the WLSSSV is removed from the main nipple assembly body.

13. The method of claim 11, wherein the main nipple assembly body at least partially defines a sidewall cavity within which the second connector is disposed while in a retracted position and out from which the second connector at least partially exits as it rotates from the retracted position towards the first connector.

14. The method of claim 11, wherein the electrical signal comprises an electrical current conveyed from the surface via an electrical line to the nipple assembly and through the pair of electrical connectors when the pair of electrical connectors are electrically engaged.

15. The method of claim 11, wherein the WLSSSV further comprises a pressure sensor and further comprising receiving data from the pressure sensor conveyed through the pair of electrical connectors when the pair of electrical connectors are electrically engaged.

16. A wireline-retrievable subsurface safety valve (WLSSSV) configured to be received within a central bore of a nipple assembly attached to a production tubing string, the WLSSV comprising:

a main WLSSSV body with a central flow bore extending there-through;

a closure member;

a first connector of a pair of electrical connectors, the first connector disposed within a recess in an external surface of the main WLSSV body, the recess and the connector configured to receive within the recess a second connector of the pair of electrical connectors that rotates into the recess on a first end of a lever of a lever assembly of the nipple assembly that pivots on a fulcrum within the nipple assembly as a second end of the lever engages against an external surface of the WLSSSV as the WLSSSV is received within the main nipple assembly body, thereby at least partially aligning the second connector with the first connector for electrical engagement of the first connector with the second connector; and an electrical actuator, the electric actuator configured to, in response to an electrical signal received via the first connector, switch the closure member between a closed state in which the closure member blocks fluid flow through the central flow bore and an open state in which the closure member does not block fluid flow through central flow bore.

17. The WLSSV of claim 16, further comprising a pressure sensor and wherein the WLSSSV is configured such that data from the pressure sensor can be conveyed through the pair of electrical connectors when the pair of electrical connectors are electrically engaged.

18. The WLSSSV of claim 16, wherein the main nipple assembly body at least partially defines a sidewall cavity within which the second connector is disposed while in a retracted position and out from which the second connector at least partially exits as it rotates from the retracted position towards the first connector.

19. The WLSSSV of claim 16, wherein the electrical signal comprises an electrical current conveyed from the surface via an electrical line to the nipple assembly and through the pair of electrical connectors when the pair of electrical connectors are electrically engaged.

20. The WLSSSV of claim 16, further comprising one or more key profiles configured to releasably lock the WLSSSV into the central bore of the nipple assembly.

* * * * *